US007928935B2

(12) United States Patent
Kanda

(10) Patent No.: US 7,928,935 B2
(45) Date of Patent: Apr. 19, 2011

(54) ELECTRIC CIRCUIT, DRIVING METHOD THEREOF, ELECTRO-OPTICAL DEVICE, AND ELECTRONIC APPARATUS

(75) Inventor: Eiji Kanda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 667 days.

(21) Appl. No.: 11/840,490

(22) Filed: Aug. 17, 2007

(65) Prior Publication Data

US 2008/0074357 A1 Mar. 27, 2008

(30) Foreign Application Priority Data

Sep. 13, 2006 (JP) ..... 2006-247656
May 15, 2007 (JP) ..... 2007-128857

(51) Int. Cl.
*G09G 3/30* (2006.01)

(52) U.S. Cl. ..... 345/77

(58) Field of Classification Search ..... 345/44–46, 345/76–83, 87–92, 36; 315/169.3; 313/463
See application file for complete search history.

(56) References Cited

U.S. PATENT DOCUMENTS 5,917,572 A 6/1999 Kurauchi et al.
6,229,506 B1 5/2001 Dawson et al.
7,057,588 B2 * 6/2006 Asano et al. ..... 345/76
7,456,810 B2 * 11/2008 Kimura ..... 345/76
2003/0209990 A1 * 11/2003 Kawasaki et al. ..... 315/169.3
2005/0237273 A1 10/2005 Ozawa et al.
2005/0237283 A1 * 10/2005 Ozawa et al. ..... 345/76
2006/0082566 A1 4/2006 Akimoto et al.

FOREIGN PATENT DOCUMENTS

JP A-06-075246 3/1994
JP A-2004-133240 4/2004
JP A-2004-246204 9/2004
JP A-2005-234593 9/2005
JP A-2005-309150 11/2005
JP A-2006-119242 5/2006
JP A-2006-349794 12/2006

* cited by examiner

*Primary Examiner* — Amare Mengistu
*Assistant Examiner* — Hong Zhou
(74) *Attorney, Agent, or Firm* — Oliff & Berridge PLC

(57) ABSTRACT

An electro-optical device includes a plurality of data lines, scan lines, and unit circuits. Each data line is supplied with a data potential corresponding to a gray scale, and each scan line is supplied with a scan signal defining a writing period. Each unit circuit includes a drive transistor generating a driving current, an electro-optical element displaying a gray scale, a capacitive element having first and second electrodes, an electric supply line, which extends in a direction so as not to intersect the scan line, connected to the second electrode in an initialization period other than the writing period, a first switching element connecting the gate and drive transistor during at least the initialization period, and a second switching element controlling an electrical connection between the data line and the first electrode based on the scan signal.

12 Claims, 11 Drawing Sheets

FIG. 5 [RESET PERIOD Pa (INITIALIZATION PERIOD $P_{INT}$)]
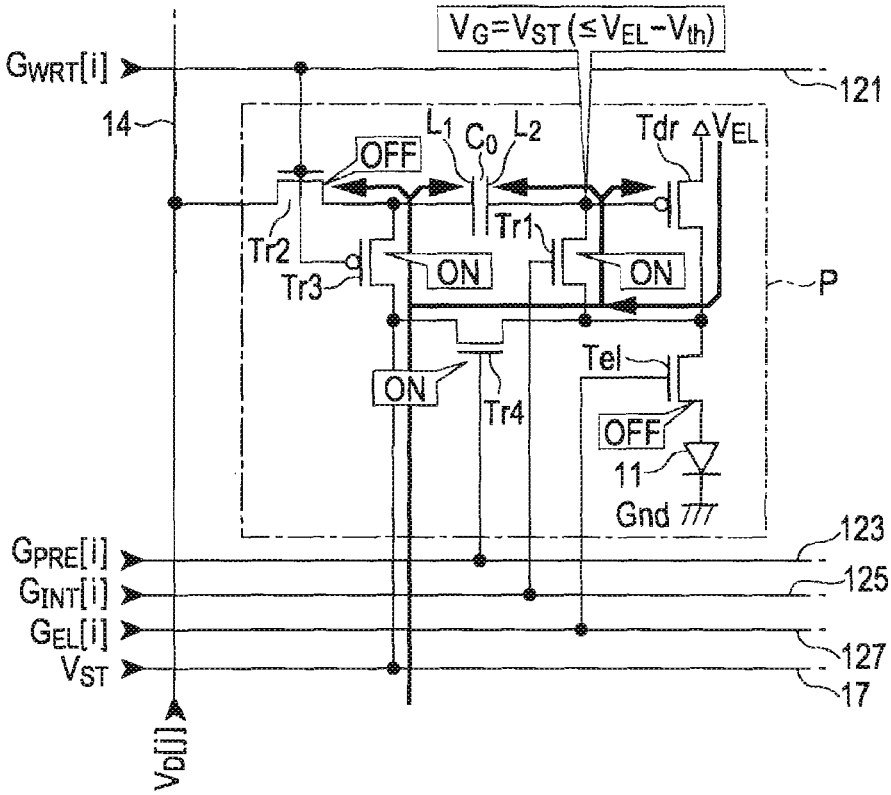
FIG. 6 [COMPENSATION PERIOD Pb (INITIALIZATION PERIOD $P_{INT}$)]
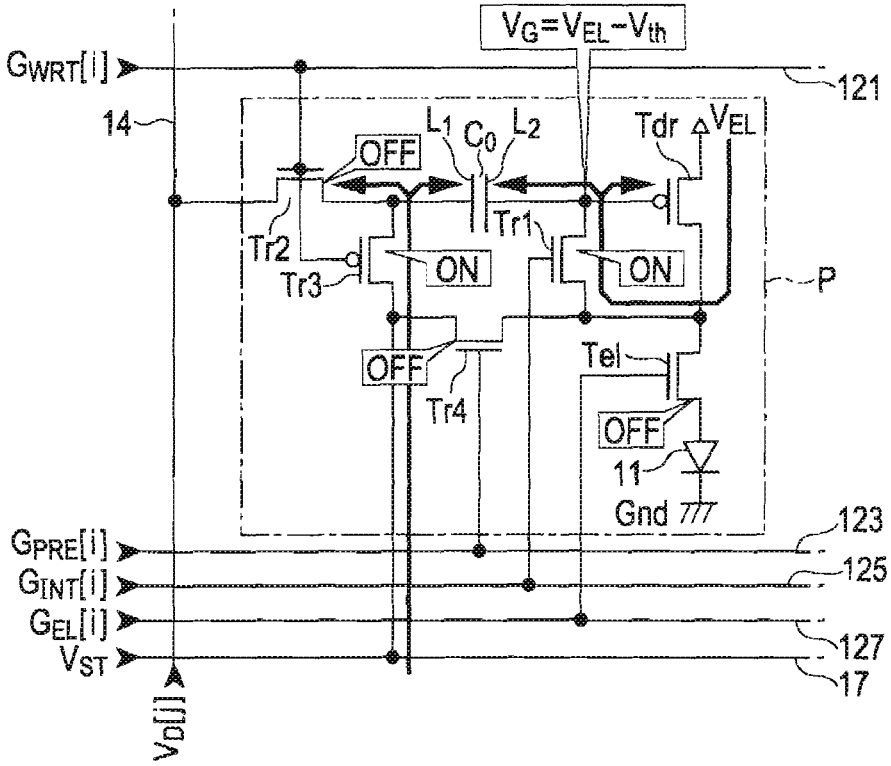

FIG. 7 [LOADING PERIOD $P_{WRT}$]
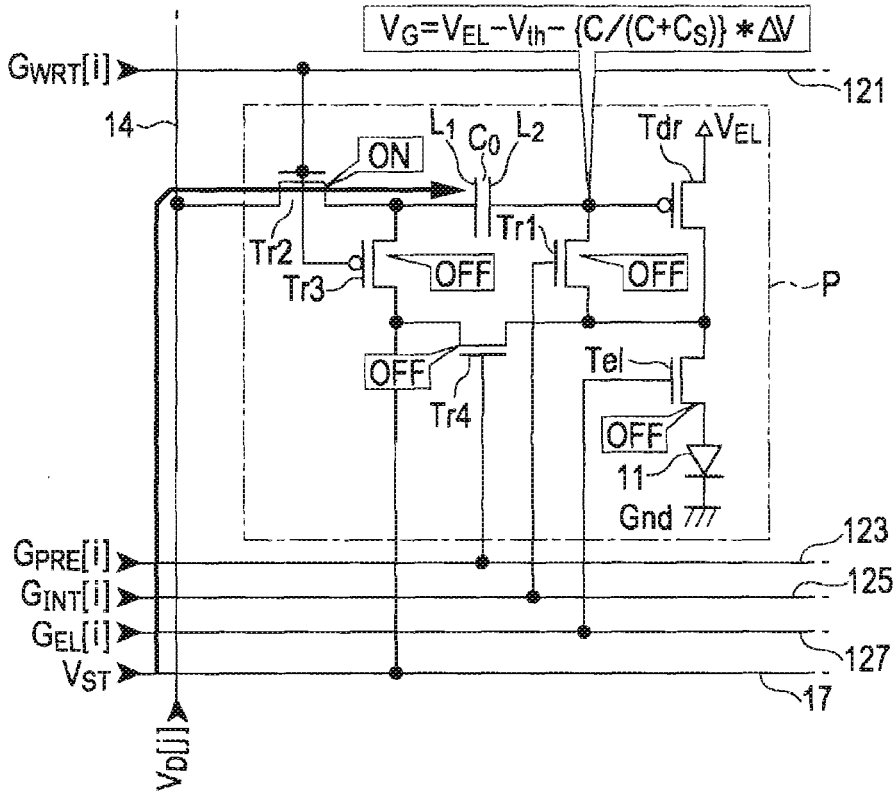
FIG. 8 [LIGHT-EMITTING PERIOD $P_{EL}$]
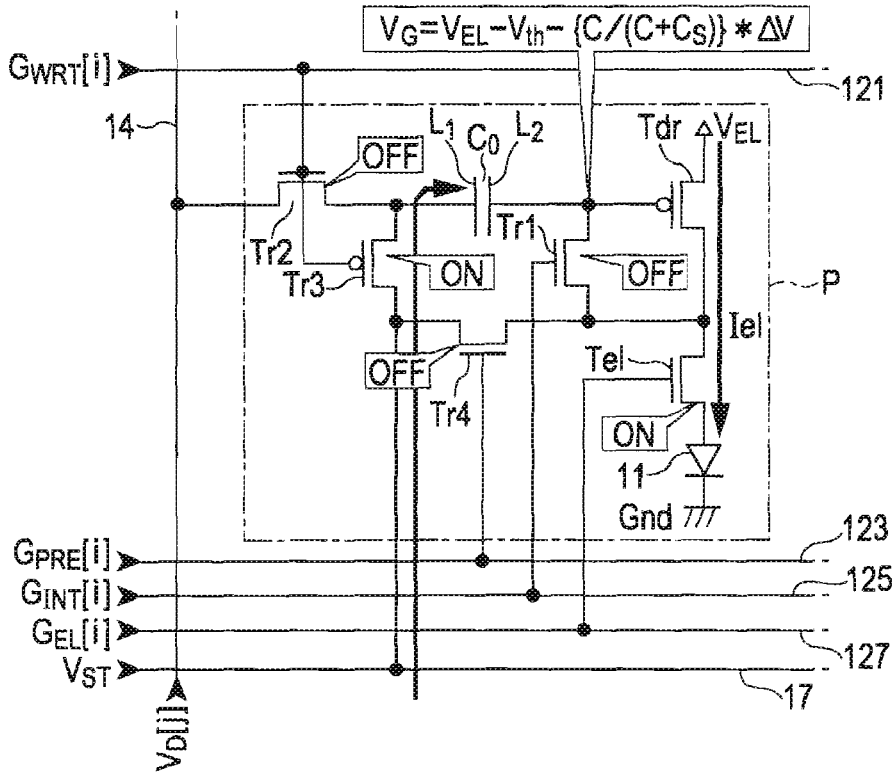

ELECTRIC CIRCUIT, DRIVING METHOD THEREOF, ELECTRO-OPTICAL DEVICE, AND ELECTRONIC APPARATUS

The entire disclosure of Japanese Patent Application Nos: 2006-247656, filed Sep. 13, 2006 and 2007-128857, filed May 15, 2007 are expressly incorporated by reference herein.

BACKGROUND

1. Technical Field

The present invention relates to a technology for controlling behaviors of a variety of electro-optical elements such as light-emitting elements made of organic electroluminescent materials.

2. Related Art

In such electro-optical elements, a level of gray scale (typically referred to as brightness) is changed according to on a supplied current. There has been suggested a structure in which the current (hereinafter referred to as "driving current") is controlled using a transistor (hereinafter referred to as "driving transistor"). However, there is a problem with such a structure in that unevenness in gray-scale level of light-emitting elements attributable to different properties (in particular, threshold voltages) of driving transistors occurs. In order to solve the gray-scale unevenness problem, U.S. Pat. No. 6,229,506 (FIG. 2), JP-A-2004-133240 (FIGS. 2 and 3) and JP-A-2004-246204 (FIGS. 5 and 6) disclose structures which are capable of compensating variations in threshold voltages of driving transistors.

FIG. 16 shows a pixel circuit P0 disclosed in U.S. Pat. No. 6,229,506. As shown in this figure, a transistor Tr1 is interposed between a gate and a drain of a drive transistor Tdr. The gate of the drive transistor Tdr is connected to a first electrode L2 of a capacitive element C0. A storage capacitor C1 is a capacitor interposed between the gate and a source of the drive transistor Tdr. A transistor Tr2 is a switching element interposed between the data line 14 and the second electrode L1 of the capacitive element C0, thereby controlling electrical connection and disconnection between the data line 14 and the second electrode L1 of the capacitive element C0, where the data line is supplied with a potential Vd (hereinafter referred to as "data potential") corresponding to a brightness set in an organic light-emitting diode element (OLED element) 110.

The aforementioned pixel circuit P0 operates in the following manner. First the transistor Tr1 is transited to an on-state by a signal S2, and thus the drive transistor Tdr is connected as a diode. At this time, a potential of the gate of the drive transistor Tdr converges to a value of "VEL−Vth" (Vth is a threshold voltage of the drive transistor Tdr). Second, the transistor Tr 2 is turned on by a signal S1 in the off-state of the transistor Tr1, and thus the electrode L1 of the capacitive element C0 and the data line 14 are electrically connected to each other. Through this operation, the potential of the gate of the drive transistor Tdr changes by a level (a level corresponding to the data potential VD) which is a value calculated by dividing a potential variation of the electrode L1 by a capacitance ratio of a capacitance of the capacitive element C0 to a capacitance of the storage capacitor C1. Third, a transistor Tel is turned on by a signal S3 when the transistor Tr2 is in the off-state. As a result, a driving current Iel which does not depend on the threshold voltage of the drive transistor is supplied to the OLED element 110 via the drive transistors Tdr and Tel. The basic principle for compensating the threshold voltage Vth of the driving transistor Tdr disclosed in the aforementioned structure is the same in the examples of the related art disclosed in JP-A-2004-133240, and JP-A-2004-246204.

In all the structures disclosed in U.S. Pat. No. 6,229,506, JP-A-2004-133240, and JP-A-2004-246204, the electrode L1 of the capacitive element C0 is in the electrically floating state due to the transition of the transistor Tr2 to the off-state during a period (hereinafter, referred to as "light-emitting period") in which the OLED element 110 actually emits light. Accordingly, a voltage of the capacitive element C0 is liable to fluctuate. For example, there is a probability that a potential of the electrode L2 changes due to noise attributable to switching operations of the transistor Tr2. As described above, when the voltage of the capacitive element C0 changes during the light-emitting period, the potential of the gate of the drive transistor Tdr or the driving current Iel corresponding to the potential of the gate of the drive transistor Tdr likewise changes. As a result, unevenness of brightness (unevenness of a display, such as crosstalk) of the OLED elements 110 occurs.

On the other hand, there is a technique of decreasing influence of the potential variation of the electrode L1 on the potential of the gate of the drive transistor Tdr. That is, when the capacitance of the capacitive element C0 or the storage capacitance C1 is increased, the potential of the gate of the drive transistor Tdr may be less affected by the potential fluctuation of the electrode L1. However, this method is accompanied with other problems having to be increased in the size of the pixel circuit P0 because it is required that the capacitance be increased. Accordingly, this method cannot be a practical solution under circumstances in which fine pixels are highly demanded.

SUMMARY

An advantage of some aspects of the invention is to provide an electro-optical device in which a variation in gate potential of a drive transistor is reduced.

According to an aspect of the invention, there is provided an electro-optical device including a plurality of data lines, a plurality of scan lines, and a plurality of unit circuits disposed to correspond to respective intersections of the plurality of data lines and the plurality of scan lines, where each of the plurality of data lines is supplied with a data potential corresponding to a level of gray scale and each of the plurality of scan lines is supplied with a scan signal which defines a writing period in which the data potential is loaded into the corresponding unit circuit, in which each of the plurality of unit circuits includes a drive transistor for generating a driving current corresponding to a potential of a gate thereof, an electro-optical element displaying a level of gray scale corresponding to the driving current, a capacitive element having a first electrode and a second electrode, an electric supply line which is electrically connected to the second electrode in an initialization period other than the writing period and which is supplied with a predetermined potential, a first switching element for electrically connecting the gate and a drain of the drive transistor to each other during at least the initialization period, and a second switching element for controlling electrical connection and disconnection between the data line and the first electrode on the basis of the scan signal, where the second electrode is connected to the gate and the electric supply line extends in a direction so as not to intersect the scan line.

In other words, the electro-optical device includes a plurality of data lines, a plurality of scan lines, and a plurality of unit circuits disposed to correspond to respective intersections of the plurality of data lines and the plurality of scan lines, where each of the plurality of data lines is supplied with a data potential corresponding to a level of gray scale and each of the plurality of scan lines is supplied with a scan signal which defines a writing period in which the data potential is loaded to the corresponding unit circuit, in which each of the plurality of unit circuits includes a drive transistor for generating a driving current corresponding to a potential of a gate thereof, an electro-optical element displaying a level of gray scale corresponding to the driving current, a capacitive element having a first electrode and a second electrode, an electric supply line which is electrically connected to the second electrode in an initialization period other than the writing period and which is supplied with a predetermined potential, a first switching element for electrically connecting the gate and a drain of the drive transistor to each other during at least the initialization period, and a second switching element for controlling electrical connection and disconnection between the data line and the first electrode on the basis of the scan signal, where the second electrode is connected to the gate and the electric supply line is arranged in parallel with the scan line.

According to another aspect of the invention, there is provided an electro-optical device, comprising a plurality of data lines, a plurality of scan lines, and a plurality of unit circuits disposed to correspond to respective intersections of the plurality of data lines and the plurality of scan lines, where each of the plurality of data lines is supplied with a data potential corresponding to a level of gray scale and each of the plurality of scan lines is supplied with a scan signal which defines a writing period in which the data potential is loaded to the corresponding unit circuit, in which each of the plurality of unit circuits includes a drive transistor for generating a driving current corresponding to a potential of a gate thereof, an electro-optical element displaying a level of gray scale corresponding to the driving current, a capacitive element having a first electrode and a second electrode, an electric supply line which is electrically connected to the second electrode in an initialization period other than the writing period and which is supplied with a predetermined potential, a first switching element for electrically connecting the gate and a drain of the drive transistor to each other during at least the initialization period, and a second switching element for controlling electrical connection and disconnection between the data line and the first electrode on the basis of the scan signal, where the electric supply line is arranged in parallel with the scan line.

In the electro-optical device above, it is preferable that the drive transistor is connected as a diode via the first switching element and thus a driving current which does not depend on a threshold voltage of the drive transistor is generated. In addition, the gate of the drive transistor is set to a potential corresponding to the data potential by the configuration in that the second switching element becomes an on-state (the electrically connected state). Moreover, the second electrode and the electric supply line are electrically connected to each other via a fourth switching element (Transistor Tr2 in FIG. 2) during the initialization period.

Further, it is preferable that the electric supply line is arranged in parallel with the scan line. For example, when the scan line is arranged to extend in a direction of a row, the electric supply line may be likewise arranged to extend in the direction of a row. In this configuration, when the first switching element and the fourth switching element simultaneously become the on-state, the compensation of the threshold voltage of the drive transistor can be implemented, but at this time a current of the drive transistor connected as a diode flows into the electric supply line. The electric supply line is supplied with a predetermined potential and the potential of the gate of the drive transistor is determined on the basis of the potential of the electric supply line. Alternatively, when the electric supply line is arranged to extend in a direction of a column intersecting the scan line, during a threshold voltage compensation period for compensating a threshold voltage of a unit circuit arranged in an arbitrary row, the electro-optical elements in other unit circuits connected to the relevant electric supply line are driven by being supplied with the driving currents corresponding to the potentials of the gates of the drive transistors. In this configuration, if a current flows into the electric supply line, a voltage drop occurs due to a resistance of the electric supply line, resulting in the variation in the potential of the gate of the drive transistor. This contributes to the display of an improper gray level. However, according to the invention, since the electric supply line and the scan line are arranged in parallel with each other, the threshold voltage compensation operations are simultaneously performed with respect to the plurality of unit circuits connected to the same electric supply line during the same period, and the light-emitting operations of the plurality of unit circuits are also performed in the same period. Accordingly, the variations in the potentials of the gates of the drive transistors are suppressed and thus precise levels of gray scale can be displayed. Here, the phrase "the electric supply line and the data line are arranged in parallel with each other" means that the electric supply line and the data line do not intersect each other. That is, the parallel arrangement described above includes the structure in which the electric supply line and the data line are not in substantially parallel with each other due to manufacturing process variations even if the electro-optical device of the invention is manufactured aiming the structure in which the electric supply line and the data line are in parallel with each other.

The term "electro-optical element" in this application means a current-driven element which displays a level of gray scale corresponding to a supplied current (driving current). A typical example of the electro-optical element is a light-emitting element (for example, OLED element) emitting light with brightness corresponding to a driving current but examples of the electro-optical element in a scope of the invention are not limited thereto. In the electro-optical device above, it is preferable that the electro-optical device further comprises a third switching element for controlling electrical connection and disconnection between the electric supply line and the first electrode of the capacitive element and for electrically connecting the electric supply line and the first electrode to each other during at least the initialization period. With such a configuration, it is possible to set the first electrode of the capacitive element to the potential supplied to the electric supply line before setting the gate of the drive transistor to a voltage corresponding to the threshold voltage of the drive transistor by connecting the transistor to serve as a diode by the use of the first switching element. Since both of the first electrode and the second electrode of the capacitive element are connected to a single electric supply line, it is possible to simplify a wiring structure.

In the electro-optical device above, it is preferable that the third switching element is in the on-state when the second switching element is in the off-state. With such a configuration, the gate of the drive transistor is set to a potential corresponding to the data potential on the basis of the scan signal thanks to the operation of the second switching element. In a period other than the writing period, for example, in the period in which the drive transistor supplies a current corresponding to the data potential to the electro-optical element, the first electrode is electrically connected to the electric supply line via the third switching element. At this time, in the case in which the electric supply line is arranged in parallel with the scan line, operations attributable to the second switching element and operations attributable to the third switching element are independently conducted without interfering with those of each other. In addition, it is possible to prevent the potential of the gate of the drive transistor from varying, while avoiding the increase in the capacitance provided in the unit circuit.

The potential of the electric supply line does not have to be always almost constant. That is, it is enough that the potential of the electric supply line is maintained at an almost constant level while the switching element is in the on-state. In the other periods, it does not matter that the potential of the electric supply line varies or is almost constant. Further, the term "almost constant" not only means a state of substantial constant but also allows a certain range of variation as long as the advantage of the invention can be accomplished even in the presence of the variation in the range. That is, during the period in which the third switching element is in the on-state, although the potential of the electric supply line varies in a range from a first potential to a second potential, a difference between levels of gray scale displayed by the electro-optical element at the first potential and at the second potential does not cause any troubles in practical use (for example, when the electro-optical element is used as a display device and the difference between the levels of gray scale at the first potential and the second potential cannot be sensed by a user), potentials in the range from the first potential to the second potential can be referred to as the "almost constant" potential.

According to further aspect of the invention, there is provided an electro-optical device, comprising a plurality of data lines, a plurality of scan lines, an electric supply line, and a plurality of unit circuits disposed to correspond to respective intersections of the plurality of data lines and the plurality of scan lines, where each of plurality of the data lines is supplied with a data potential corresponding to a level of gray scale, each of the plurality of scan lines is supplied with a scan signal which defines a writing period in which the data potential is loaded into the corresponding unit circuit, and the electric supply line is supplied with a predetermined potential, in which each of the plurality of unit circuits includes a drive transistor for generating a driving current corresponding to a potential of a gate thereof, an electro-optical element displaying a level of gray scale corresponding to the driving current, a first switching element for controlling electrical connection and disconnection between the gate and a drain of the drive transistor, a capacitive element having a first electrode and a second electrode, a second switching element for controlling electrical connection and disconnection between each of the plurality of data lines and the first electrode on the basis of the scan signal, a third switching element which is a switching element for controlling electrical connection and disconnection between the electric supply line and the first electrode, which is in an on-state when the second switching element is in an off-state, and which is in the off-state when the second switching element is in the on-state, and a fourth switching element interposed between the first electrode and the second electrode for controlling electrical connection and disconnection between the first electrode and the second electrode, where the second electrode is connected to the gate of the drive transistor and the electric supply line extends in a direction so as not to intersect the scan line.

In other words, the electro-optical device includes a plurality of data lines, a plurality of scan lines, an electric supply line, and a plurality of unit circuits disposed to correspond to respective intersections of the plurality of data lines and the plurality of scan lines, where each of plurality of the data lines is supplied with a data potential corresponding to a level of gray scale, each of the plurality of scan lines is supplied with a scan signal which defines a writing period in which the data potential is loaded into the corresponding unit circuit, and the electric supply line is supplied with a predetermined potential, in which each of the plurality of unit circuits includes a drive transistor for generating a driving current corresponding to a potential of a gate thereof, an electro-optical element displaying a level of gray scale corresponding to the driving current, a first switching element for controlling electrical connection and disconnection between the gate and a drain of the drive transistor, a capacitive element having a first electrode and a second electrode, a second switching element for controlling electrical connection and disconnection between each of the plurality of data lines and the first electrode on the basis of the scan signal, a third switching element which is a switching element for controlling electrical connection and disconnection between the electric supply line and the first electrode, which is in an on-state when the second switching element is in an off-state, and which is in the off-state when the second switching element is in the on-state, and a fourth switching element interposed between the first electrode and the second electrode for controlling electrical connection and disconnection between the first electrode and the second electrode, where the second electrode is connected to the gate of the drive transistor and the electric supply line is arranged in parallel with the scan line.

According to still further aspect of the invention, there is provided an optical device comprising a plurality of data lines, a plurality of scan lines, a plurality of electric supply lines, and a plurality of unit circuits disposed to correspond to respective intersections of the plurality of data lines and the plurality of scan lines, where each of plurality of the data lines is supplied with a data potential corresponding to a level of gray scale, each of the plurality of scan lines is supplied with a scan signal which defines a writing period in which the data potential is loaded into the corresponding unit circuit and the electric supply line is supplied with a predetermined potential, in which each of the plurality of unit circuits includes a drive transistor for generating a driving current corresponding to a potential of a gate thereof, an electro-optical element displaying a level of gray scale corresponding to the driving current, a first switching element (for example, transistor Tr1 in FIG. 2) for controlling electrical connection and disconnection between the gate and a drain of the drive transistor, a capacitive element having a first electrode and a second electrode connected to the gate of the drive transistor, a second switching element (for example, transistor Tr2 in FIG. 2) for controlling electrical connection and disconnection between the data lines and the first electrode on the basis of the scan signal, a third switching element (for example, transistor Tr3 in FIG. 2) which is a switching element for controlling electrical connection and disconnection between the electric supply line and the first electrode, which is in an on-state when the second switching element is in an off-state, and which is in the off-state when the second switching element is in the on-state, and a fourth switching element interposed between the first electrode and the second electrode for controlling electrical connection and disconnection between the first electrode and the second electrode, where the electric supply line is arranged in parallel with the scan line.

In the electro-optical device according to this aspect, it is preferable that after the fourth switching element is turned on a reset period (for example, period Pa in FIG. 4), the first switching element is turned on in a first period (for example, compensation period Pb in FIG. 4), the second switching element is turned on and simultaneously the third switching element is turned off in a second period (for example, writing period PWRT in FIG. 4) which is the succeeding period of the first period, and the second switching element is turned off and simultaneously the third switching element is turned on in a third period (for example, light-emitting period PEL in FIG. 4) which is the succeeding period of the second period. The capacitive element according to this aspect serves as a coupling capacitor which changes the potential of the gate of the drive transistor to a potential corresponding to the data potential and also serves as a storage capacitor for maintaining the gate of the drive transistor at a predetermined potential during the third period.

In the electro-optical device according to this aspect, it is preferable that the electric supply line is formed of a wiring layer which is the same layer as used for forming the gate of the drive transistor. With such a configuration, it is possible to form the electric supply line and the gate of the drive transistor by the same process and thus it is possible to form the electric supply line without forming an additional wiring layer.

In the electro-optical device according to this aspect of the invention, it is preferable that in each of the plurality of unit circuits, the second switching element and the third switching element are counter conductive transistors to each other, and a gate of the second switching element and a gate of the third switching element are supplied with a common scan signal. With such a configuration, a wiring for controlling the second switching element and a wiring for controlling the third switching element can be shared and thus a wiring structure can be simplified and can be easily manufactured.

The electro-optical device according to the invention may be used in a variety of kinds of electronic apparatuses. A typical example of the electronic apparatus is an apparatus using an electro-optical device as a display device. For example, a personal computer and a mobile phone are included in such electronic apparatuses. However, the use of the electro-optical device according to the invention is not limited to the display device. That is, when the electro-optical device according to the invention is applied to an image forming apparatus (printer) which forms a latent image on an image carrier such as a photoconductor drum by light radiation, the electro-optical device can be used an exposing device (for example, an exposing head) for exposing the image carrier.

BRIEF DESCRIPTION OF THE DRAWINGS

The invention will be described with reference to the accompanying drawings, wherein like numbers reference like elements.

FIG. 5 is a circuit diagram for explaining the operation of a pixel circuit in a reset period;

FIG. 6 is a circuit diagram for explaining the operation of the pixel circuit in a compensation period;

FIG. 7 is a circuit diagram for explaining the operation of the pixel circuit in a writing period;

FIG. 8 is a circuit diagram for explaining the operation of the pixel circuit in a light emitting period;

DESCRIPTION OF EXEMPLARY EMBODIMENTS

A: Structure of Electro-Optical Device

Figure 1:
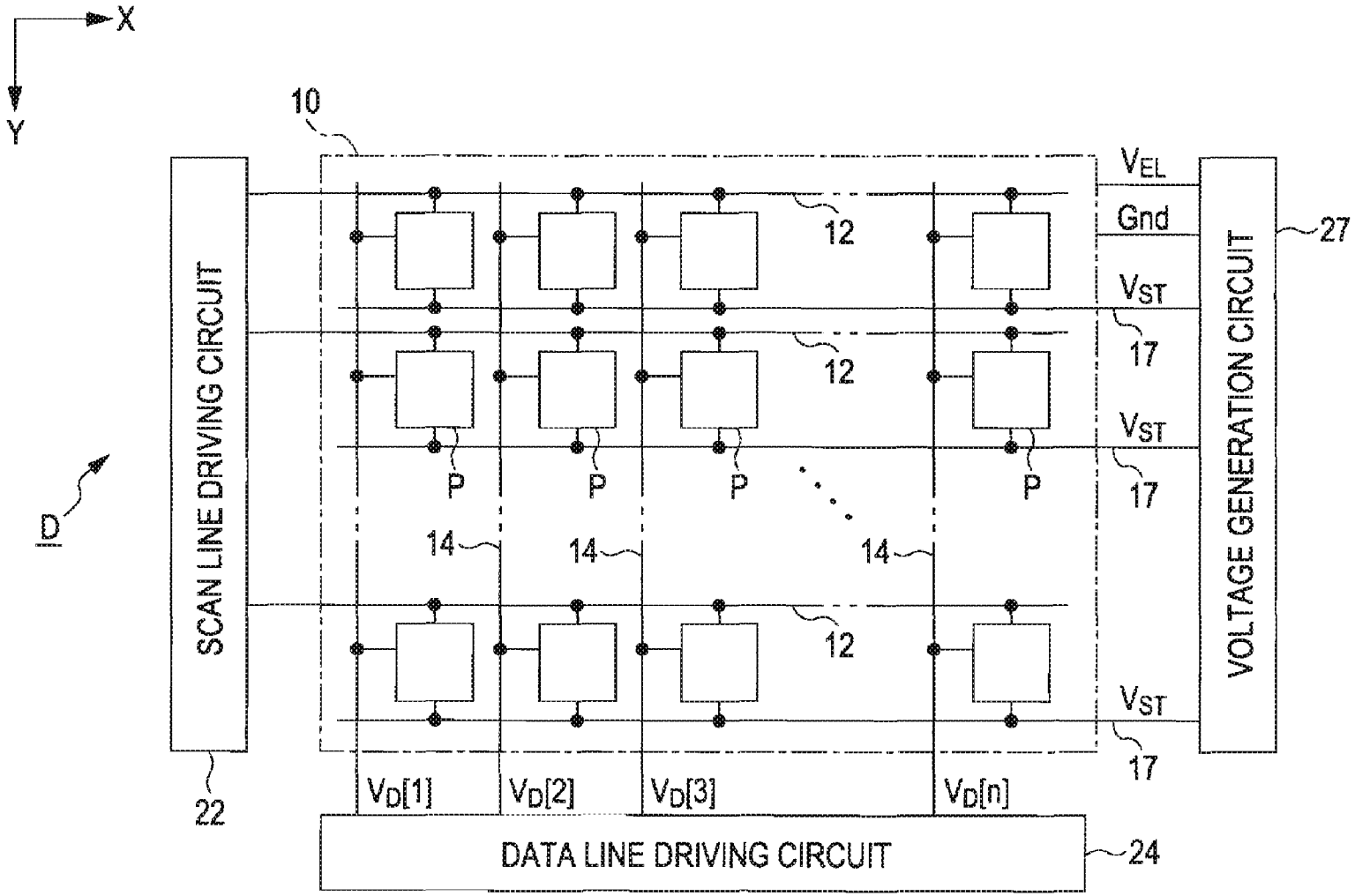
FIG. 1 is a block diagram illustrating an electro-optical device according to an embodiment of the invention.

FIG. 1 shows a structure of an electro-optical device according to an embodiment of the invention. The electro-optical device D is a device included in a variety of electronic apparatuses as a display device. The electro-optical device D includes a pixel array portion 10 in which a plurality of pixel circuits P are arranged on a plane, a scan line driving circuit 22 and a data line driving circuit 24 for driving the pixel circuits P, and a voltage generation circuit 27 for generating a variety of voltages used therein. In FIG. 1, even though the scan line driving circuit 22, the data line driving circuit 24 and the voltage generation circuit 27 are illustrated in the form of separate circuits, some of or all of the circuits can be formed in the form of an integrated circuit. Alternatively, the scan line driving circuit 22 (or the data line driving circuit 24, or the voltage generation circuit 27) can be mounted in the electro-optical device in the form of discrete integrated circuit (IC) chips.

As shown in FIG. 1, the pixel array portion 10 has the number m of control lines 12 extending in an X direction, the number n of data lines 14 extending in an Y direction and perpendicularly intersecting the control lines 12, and the number m of electric supply lines 17 extending in the Y direction in parallel with the control lines 12 where the numbers m and n are natural numbers. Each of the pixel circuits P is disposed at a position corresponding to an intersection out of intersections of the data lines 14, the control lines and the electric supply lines 17. The pixel circuits P are arranged in the form of a matrix of m rows (vertical direction) and n columns (lateral direction).

The scan driving circuit 22 selects some pixel circuits out of the plurality of the pixel circuits P row by row in each horizontal scan period. The data line driving circuit 24 generate data potentials VD(1) to VD(n) corresponding to the n pixel circuits P associated with a single row selected by the scan driving circuit in each of the horizontal scan periods and transmits them to the corresponding data lines 14. In the horizontal scan period in which an i-th row (i is an integer in the range of $1 \leqq i \leqq m$) is selected, the data potential VD(j) transmitted to a j-th data line 14 (j is an integer in the range of the range of $1 \leqq j \leqq n$) is a potential corresponding to a level of gray scale set to the pixel circuit P arranged in a position of in the i-th row and the j-th column.

The voltage generation circuit 27 generates a potential VEL on the high level side of a power source (hereinafter, referred to as "power source potential"), a potential Gnd on the low level side if the power source (hereinafter, referred to as "ground potential"), and an almost constant potential VST. The almost constant potential VST is commonly transmitted to all of the electric supply lines 17, and then loaded into each of the pixel circuits P.

Figure 2:
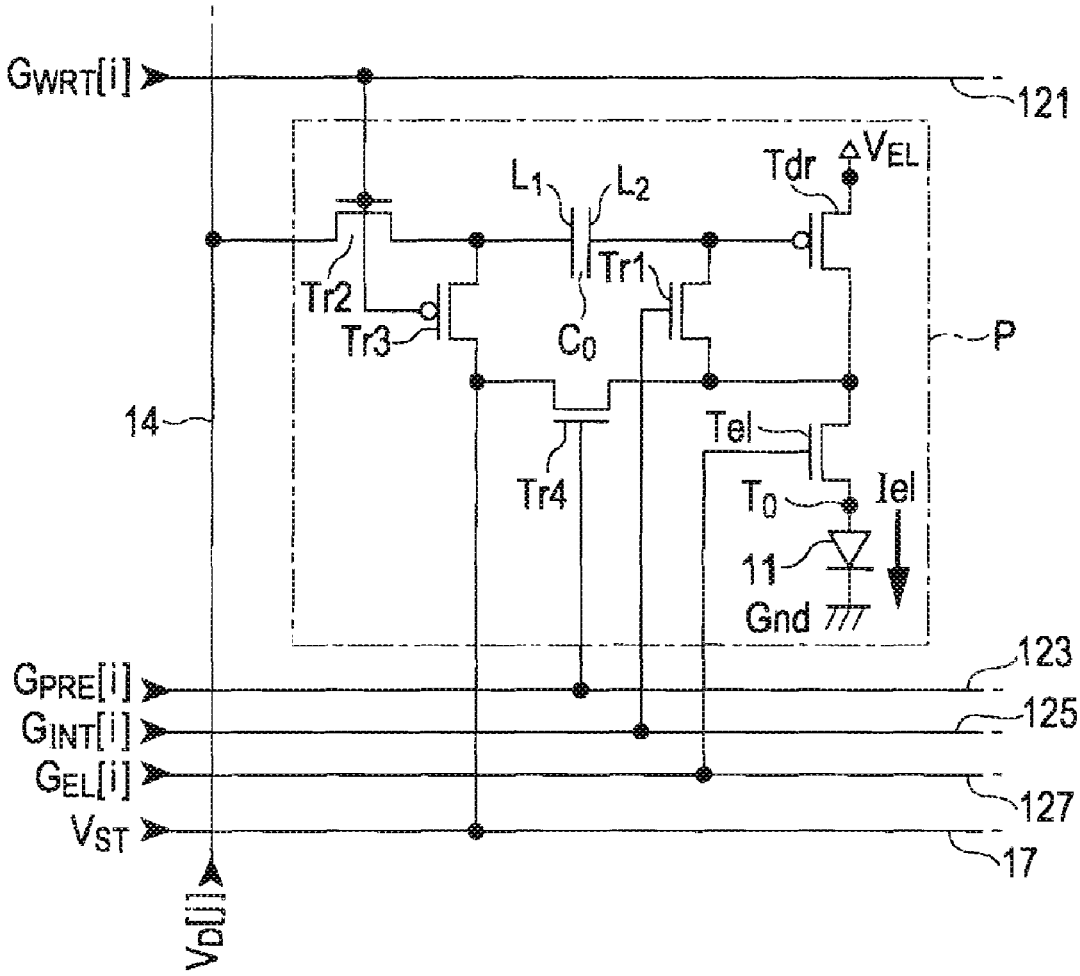
FIG. 2 a circuit diagram illustrating a pixel circuit.

Next, the structure of each pixel circuit P will be described with reference to FIG. 2. FIG. 2 illustrates only one pixel circuit P disposed in a position of the i-th row and the j-th column but the other pixel circuits P have the same structure as the structure shown in FIG. 2.

As shown in FIG. 2, the pixel circuit P has an electro-optical element 11 interposed between a power source line supplied with the power source potential VEL and a ground line supplied with the ground potential Gnd. The electro-optical device 11 is a current-driven light-emitting element emitting light with a brightness corresponding to a driving current Iel supplied thereto. Typically, the electro-optical element 11 is an OLED element having a light-emitting layer made of an organic electro luminance material and interposed between an anode and a cathode.

As shown in FIG. 2, the control line 12 illustrated in FIG. 1 is shown as a single line for convenience's sake. However, the control line 12 actually includes four wirings (a scan line 121, a first control line 123, a second control line 125 and a light-emitting control line 127). Each of the wirings is supplied with a predetermined signal from the scan line driving circuit 22. For example, the i-th scan line 121 is supplied with a scan signal GWRT(i) for selecting the pixel circuits P associated with the i-th row. The first control line 123 is supplied with a reset signal GPRE(i) and the second control line 125 is supplied with an initialization signal GINT(i). The light-emitting control line 127 is supplied with a light-emitting control signal GEL(i) which defines a period (light emitting period PEL, which will be described below) that it takes for the electro-optical element to actually emit light. Waveforms of these signals and operations of the pixel circuits P corresponding to the waveforms of these signals will be detailed below.

As shown in FIG. 2, a drive transistor Tdr which is a p-channel transistor and a light-emitting control transistor Tel are interposed in the middle of a path from the power source line to the electro-optical element 11. The drive transistor Tdr generates a driving current Iel corresponding to a potential VG of a gate thereof. A source of the drive transistor Tdr is connected to the power source line and to a drain of the light-emitting control transistor Tel. The light-emitting control transistor Tel is an element for defining a period during which the driving current Iel is actually supplied to the electro-optical element 11. A source of the light-emitting control transistor Tel is connected to an anode of the electro-optical element 11 and a gate of the light-emitting control transistor Tel is connected to the light-emitting control line 127. Accordingly, in a period during which the light-emitting control signal GEL(i) is maintained at a low level, the light emitting control transistor Tel is in the off-state. Thus, the supply of the driving current Iel to the electro-optical element 11 is suspended. On the other hand, when the light emitting control signal GEL(i) is transited to a high level, the light emitting control transistor Tel is turned on and the supply of the driving current Iel to the electro-optical element 11 is resumed. The light-emitting control transistor Tel may be interposed between the drive transistor Tdr and the power source line.

An n-channel transistor Tr1 is interposed between the gate and the drain of the drive transistor Tdr. A gate of the n-channel transistor Tr1 is connected to the second control line 125. Accordingly, when the initialization signal GINT(i) is transited to the high level, the transistor Tr1 is turned on and the drive transistor Tdr is connected as a diode, but when the initialization signal GINT(i) is transited to the low level, the transistor Tr1 is turned off and the diode connection of the drive transistor Tdr is cancelled.

In FIG. 2, a capacitive element C0 is a capacitor for storing a voltage between a first electrode L1 and a second electrode L2 thereof. The second electrode L2 is connected to the gate of the drive transistor Tdr. An n-channel transistor Tr2 is interposed between the first electrode L1 of the capacitive element C0 and the data line 14 and a p-channel transistor Tr3 (a counter conductive transistor to the transistor Tr2) is interposed between the first electrode of the capacitive element C0 and the electric supply line 17. The transistor Tr2 is a switching element for performing switching operations in order to control electrical connection and disconnection between the first electrode L1 and the data line 14. The transistor Tr3 is a switching element for performing switching operations in order to control electrical connection and disconnection between the first electrode L1 and the electric supply line 17. The gate of the transistor Tr2 and the gate of the transistor Tr3 are commonly connected to the scan line 121. The transistor Tr2 and the transistor Tr3 complementarily operate. That is, when the scan signal GWRT(i) has the high level, the transistor Tr2 is turned on and the transistor Tr3 is turned off, but when the scan signal GWRT(i) has the low level, the transistor Tr2 is turned off and the transistor Tr3 is turned on.

In FIG. 2, the n-channel transistor Tr4 is a switching element interposed between the first electrode L1 of the capacitive element C0 and the second electrode L2 of the capacitive element C0 in order to control electrical connection and disconnection between the first electrode L1 and the second electrode L2 of the capacitive element C0. In addition, an end of the transistor Tr4 is connected to the first electrode L1 via the transistor Tr2 and the other end of the transistor Tr4 is connected to the second electrode L2 via the transistor Tr1. A gate of the transistor Tr4 is connected to the first control line 123, In a period during which the transistors Tr1 and Tr3 are maintained in the on-state, when the reset signal GPRE(i) is transited to the high level, the transistor Tr4 is turned on and the first electrode L1 and the second electrode L2 are electrically short-circuited.

B: Structure of Electro-Optical Device

Figure 3:
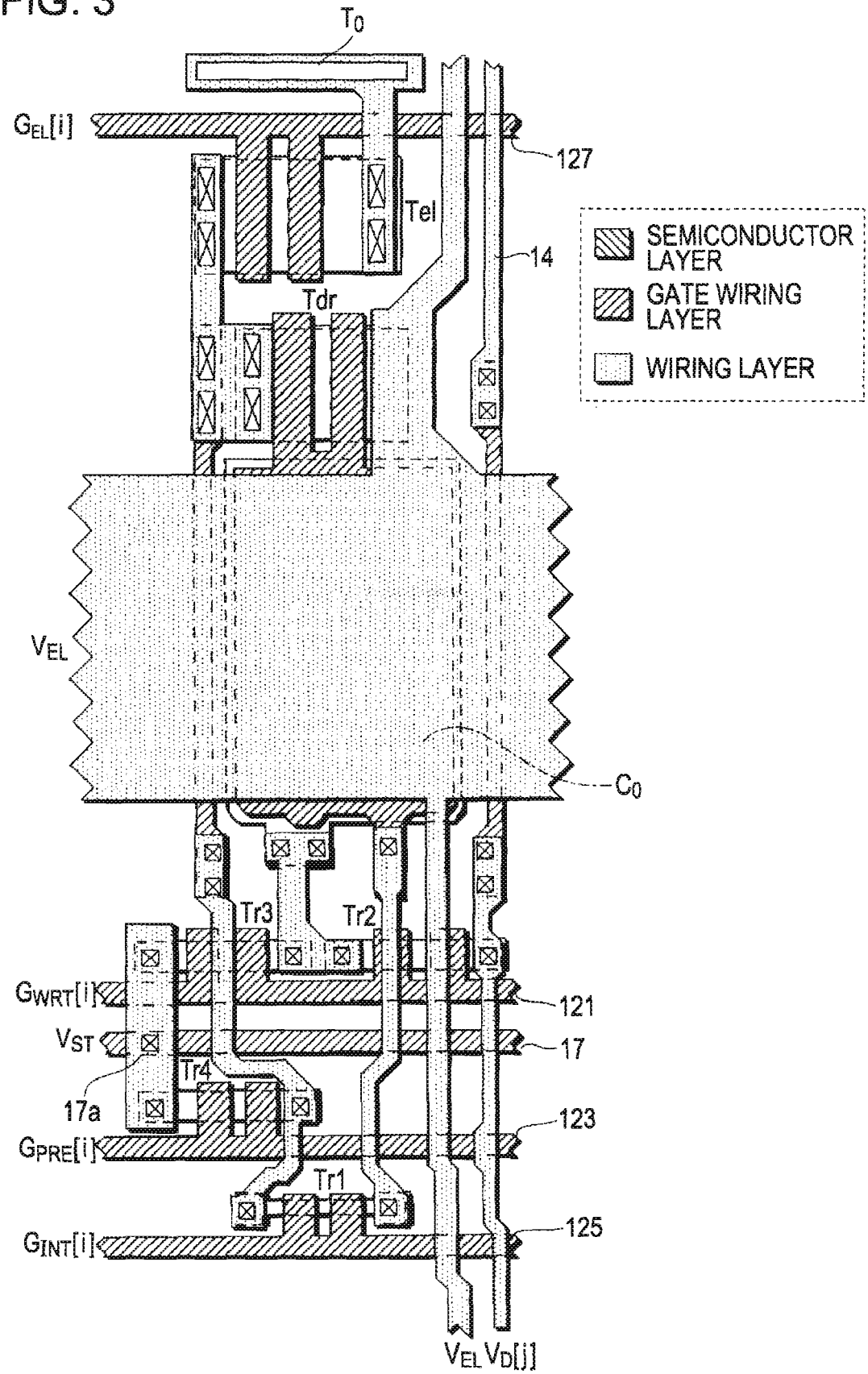
FIG. 3 is a schematic plan view illustrating main part of the electro-optical device.

FIG. 3 shows the structure of a single pixel of the electro-optical device. FIG. 3 illustrates only a semiconductor layer, a gate wiring layer, and a source wiring layer, but the pixel of the electro-optical device includes more layers and elements. For example, these layers are stacked on a glass substrate and insulating layers are interposed between every two layers of the stack thereof. However, in FIG. 3, the glass substrate and the insulating layers are omitted for convenience's sake. In addition, an insulating layer is formed on the wiring layer and an electro-optical element 11 connected to the source wiring layer via a terminal T0 is formed on the insulating layer. Moreover, a ground electrode is formed on the electro-optical element 11 but these are also omitted. An insulating layer is provided between the gate wiring layer and the semiconductor layer and thus the capacitive element C0 is formed by the electrode L1 provided in the semiconductor layer and the electrode L2 provided in the gate wiring layer.

The electric supply line 17 supplied with the power source potential VST is arranged in parallel with the aforementioned control line 12 including four wirings (the scan line 121, the first control line 123, the second control line 125, and the light emitting control line 127). The electric supply line 17 is formed of a wiring layer (the gate wiring layer) interposed between the scan line 121 and the first control line 123. The electric supply line 17 is connected to sources (or drains) of the transistors Tr3 and Tr4 via wirings 17*a* of the source wiring layer formed through contact holes.

C: Operation of Electro-Optical Device

Figure 4:
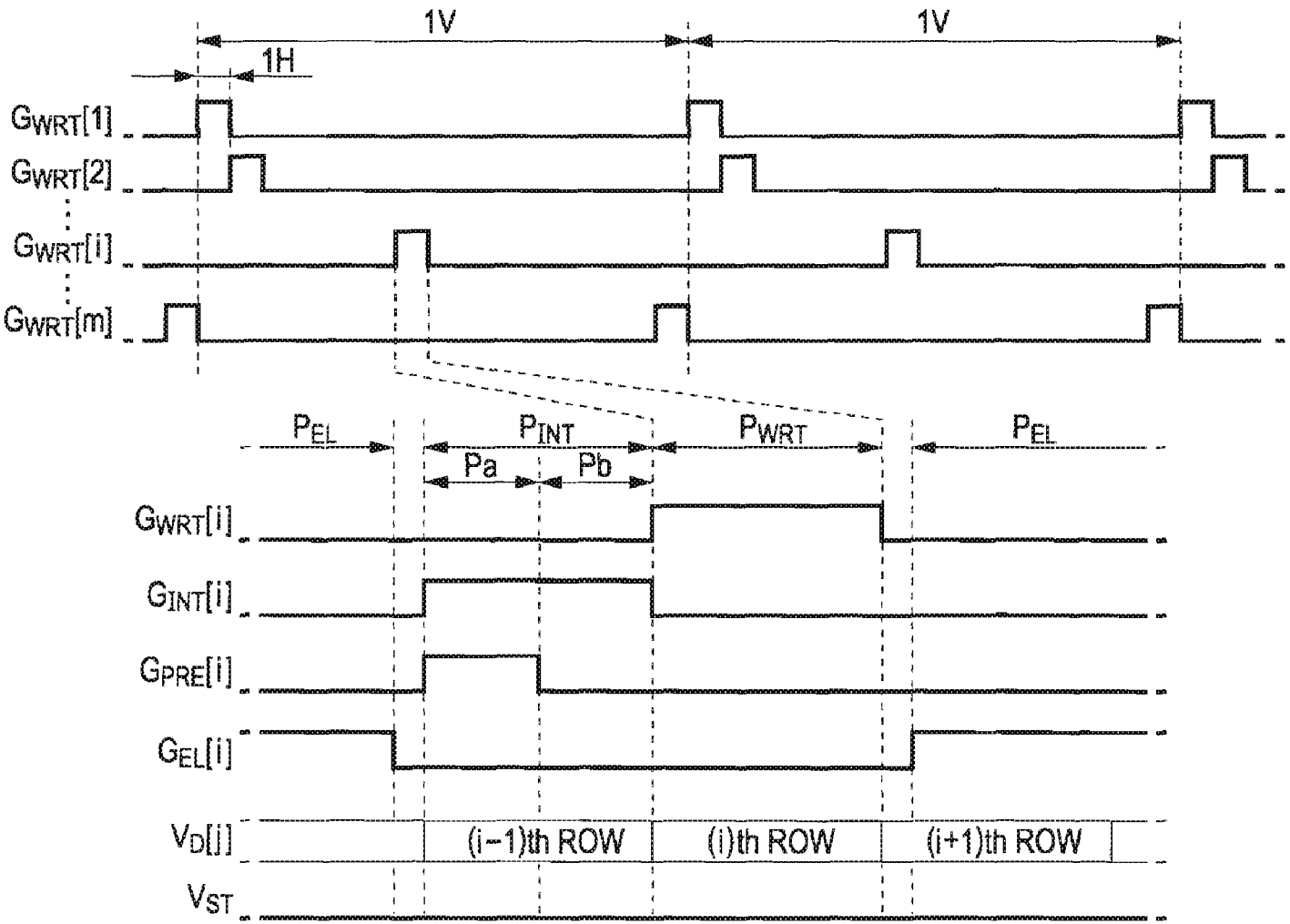
FIG. 4 is a timing chart illustrating waveforms of signals.

Next, waveforms of the signals generated by the scan line driving circuit 22 will be described with reference to FIG. 4. As shown in FIG. 4, scan signals GWRT(1) to GWRT(m) are sequentially transited to the high level in the corresponding horizontal scan periods 1H, respectively. That is, the scan signal GWRT(i) is maintained at the high level during the i-th horizontal scan period of the vertical scan periods 1V but maintained at the low level during the other periods. The transition of the scan signal GWRT(i) to the high level means the selection of pixel circuits P in the i-th row. Hereinafter, the period (the horizontal scan period) during which the corresponding scan signal of the scan signals GWRT(1) to GWRT (m) is maintained at the high level is referred to as "writing period PWRT". In FIG. 4, it is exemplified that a falling of the scan signal GWRT(i) and a rising of the scan signal GWRT (i+1) are simultaneously performed. Alternatively, the electro-optical device may be constructed in a manner such that a rising of the scan signal GWRT(i+1) is started after a falling of the scan signal GWRT(i). That is, there may be an interval between the writing periods PWRT.

The initialization signal GINT(i) becomes the high level in a period (hereinafter, referred to as "initialization period") coming right before the writing period starts, that is, right before the scan signal GWRT(i) becomes the high level, but is maintained at the low level during the other periods. As shown in FIG. 4, the initialization period PINT includes a reset period Pa and a compensation period Pb which is subsequent to the reset period Pa. During the compensation period Pb, a potential VG of the gate of the drive transistor Tdr is set to a potential corresponding to a threshold voltage of the gate of the drive transistor. The reset signal GPRE(i) becomes the high level during the reset period within the initialization period PINT in which the initialization signal GINT(i) becomes the high level. However, the reset signal GPRE(i) is maintained at the low level during the other periods.

The light emission signal GEL(i) becomes the high level in a period PEL (hereinafter, referred to as "light-emitting period") between the end of the writing period PWRT in which the scan signal GWRT(i) has the high level and the beginning of the initialization period PINT in which the initialization signal GINT(i) has the high level. However, the light emission signal GEL(i) is maintained at the low level during the other periods (the total of the initialization period PINT and the writing period PWRT).

The operation of the pixel circuit P will be detailed with reference to FIGS. 5 to 8. Hereinafter, the operation of the pixel circuit P disposed at a position of the i-th row and the j-th column will be described period by period with respect to the reset period Pa, the compensation period Pb, the writing period PWRT, and the light-emitting period PEL.

(a) Reset Period Pa (Initialization Period PINT)

As shown in FIG. 4, during the reset period Pa, the initialization signal GINT(i) and the reset signal GPRE(i) are maintained at the high level and the scan signal GWRT(i) and the light emission signal GEL(i) are maintained at the low level. Accordingly, as shown in FIG. 5, the transistors Tr1, Tr3, and Tr4 are transited to the on-state but the transistor Tr2 and the light emitting control transistor Tel are maintained in the off-state. Under this condition, the first electrode L1 and the second electrode L2 of the capacitive element C0 are electrically connected to each other via the transistors Tr3, Tr4, and Tr1. Accordingly, electric charges accumulated in the capacitive element C0 until the time right before the beginning of the reset period Pa are completely eliminated. By the elimination of the charges accumulated in the capacitive element C0, it becomes possible to set the potential VD of the gate of the drive transistor to a predetermined level with high precision in the compensation period Pb and the writing period PWRT, regardless of the state of capacitive element C0 (regardless the charges remaining in the capacitive element C0) at the time of the beginning of the reset period Pa. Further, since the gate of the drive transistor Tdr is electrically connected to the electric supply line 17 via the transistors Tr1 and Tr4 in the reset period Pa, the potential VG of the gate of the drive transistor Tdr becomes almost equal to the potential VST generated by the voltage generation circuit 27. In this embodiment, the potential VST is lower than a level corresponding to a difference (VEL−Vth) between the power source potential VEL and the threshold voltage of the drive transistor Tdr. In this embodiment, the drive transistor Tdr is a p-channel transistor. Accordingly, the drive transistor Tdr is turned on by the supply of the potential VST to the gate. That is, the potential VST is a potential to turn the drive transistor Tdr on when it is supplied.

(b) Compensation Period Pb (Initialization Period PINT)

In the compensation period Pb, as shown in FIG. 4, the reset signal GPRE(i) is transited to the low level but the other signals are maintained at the same levels as in the reset period Pa. Under this condition, as shown in FIG. 6, the transistor Tr4 is transited to the off-state from the state shown in FIG. 5. Accordingly, while the first electrode L1 connected to the electric supply line 17 via the transistor Tr3 is maintained at the potential VST, the potential of the second electrode L2 (that is, the potential VG of the gate of the drive transistor Tdr) is raised to the level corresponding to the difference between the power source potential VEL and the threshold voltage Vth from the potential VST set during the reset period Pa.

(c) Writing Period PWRT

In the writing period PWRT, as shown in FIG. 4, the scan signal GWRT(i) is transited to the high level, and the initialization signal GINT(i), the reset signal GPRE(i), and the lighting signal GEL(i) are maintained at the low level. Accordingly, as shown in FIG. 7, the transistors Tr1, Tr3 and Tr4 and the light emitting control transistor Tel are maintained in the off-state, but the transistor Tr2 is transited to the on-state. As a result, the data line 14 and the first electrode L1 are electrically connected to each other. Accordingly, the potential of the first electrode L1 changes to the data potential VD(j) corresponding to a level of gray scale set in the electro-optical element 11 from the potential VST which is supplied during the compensation period Pb.

As shown in FIG. 7, in the writing period PWRT, the transistor Tr1 is in the off-state and an impedance of the gate of the drive transistor Tdr is high enough. Accordingly, when a potential of the first electrode L1 changes by a value corresponding to the variation ΔV(=VST−VD[j]) from the potential VST in the compensation period Pb to the data potential VD(j), the potential of the second electrode L2 (the potential VG of the gate of the drive transistor Tdr) changes from the previous potential (VEL−Vth) due to the coupling capacitor. The variation in the potential of the second electrode L2 is determined depending on the capacitance ratio of the capacitance of the capacitive element C0 to the total of parasitic capacitances (for example, a capacitance attributable to the gate of the drive transistor Tdr and capacitances attributable to a plurality of wirings). In more detail, when the capacitance of the capacitive element C0 is defined as "C" and the total of the parasitic capacitances is defined as "Cs", the variation of the potential of the second electrode L2 is expressed by the formula "ΔV·C/(C+Cs)". Accordingly, the potential VG of the gate of the drive transistor Tdr in the writing period PWRT is stabilized at a level expressed by the following formula (1).

$$VG=VEL-Vth-k\cdot\Delta V \quad (1)$$

where, k=C/(C+Cs)

(d) Light-Emitting Period PEL

In the light-emitting period PEL, as shown in FIG. 4, since the initialization signal GINT(i) and the reset signal GPRE(i) are maintained at the low level, the transistors Tr1 and Tr4 are maintained in the off-state. In addition, since the scan signal GWRT(i) is maintained at the low level during the light-emitting period PEL, as shown in FIG. 8, the transistor Tr2 is transited to the off-state and the transistor Tr3 is transited to the on-state. Accordingly, the first electrode L1 of the capacitive element C0 is electrically disconnected from the data line 14 thanks to the state of the transistor Tr2 which is in the off-state, but is electrically connected to the electric supply line 17 via the transistor Tr3 which is in the on-state. As a result, the potential of the first electrode L1 is fixed to the potential VST during the light-emitting period PEL, and thus the potential VG (the potential of the second electrode L2) of the gate of the drive transistor Tdr is maintained at a constant level. In this embodiment, the capacitive element C0 serves not only as the coupling capacitor for setting the gate of the drive transistor Tdr to a predetermined potential (the potential expressed by the formula (1)) during the writing period PWRT in which the first electrode L1 is connected to the data line 14 but also as a storage capacitor for maintaining the gate of the drive transistor Tdr at a constant potential during the light-emitting period PEL in which the first electrode L1 is connected to the electric supply line 17.

Further, since the light emission signal GEL(i) is maintained at the high level during the light-emitting period, as shown in FIG. 8, the light emitting control transistor Tel is turned on and thus a current path in the driving current Iel is formed. Accordingly, the driving current Iel corresponding to the potential VG of the gate of the drive transistor Tdr is supplied from the power source line to the electro-optical element 11 via the drive transistor Tdr and the light emitting control transistor Tel. Thanks to the supply of the driving current Iel, the electro-optical element 11 emits light with brightness corresponding to the data potential VD(j).

When it is assumed that the drive transistor Tdr operates in a saturation region, the driving current Iel is expressed by the following formula (2), where "β" is a gain coefficient of the drive transistor Tdr and "Vgs" is a gate-to-source voltage of the drive transistor Tdr:

$$Iel=(\beta/2)(Vgs-Vth)2=(\beta/2)(VG-VEL-Vth)2 \quad (2),$$

The formula (2) is modified to the following formula by the substitution of the formula (1):

$$Iel=(\beta/2)\ \{(VEL-Vth-k\cdot\Delta V)-VEL-Vth\}2=(\beta/2)(k\cdot\Delta V)\ 2$$

The driving current Iel supplied to the electro-optical element 11 is determined depending on only the difference ΔV(=VST−VD(j)) between the data potential VD(j) and the potential VST, and thus the driving current Iel does not depend on the threshold voltage Vth of the drive transistor Tdr. Accordingly, unevenness of brightness attributable to the variations in the threshold voltages Vth of the pixel circuits P is suppressed.

Figure 15:
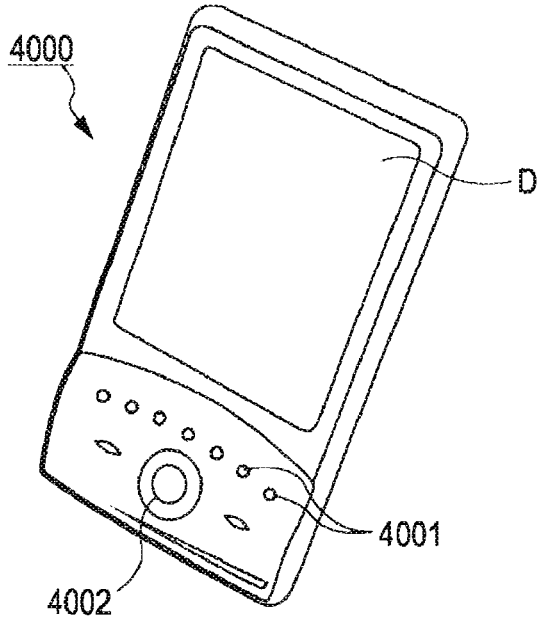
FIG. 15 is a perspective view illustrating the detailed structure of the electronic apparatus according to the invention.
Figure 16:
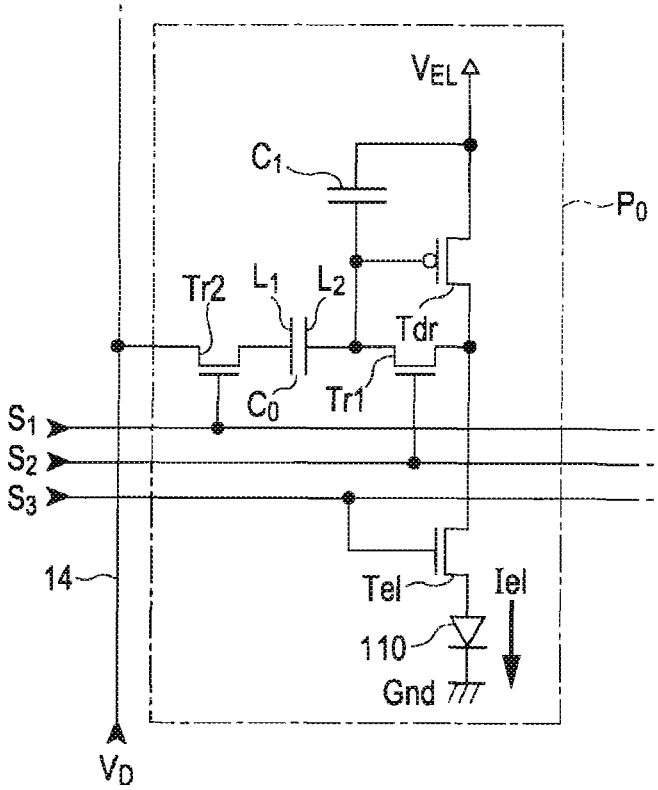
FIG. 16 is a circuit diagram illustrating a pixel circuit according to a related art.

In the pixel circuit P0 shown in FIG. 15, the electrode L1 of the capacitive element C0 becomes the floating state during the light-emitting period and thus the potential of the electrode L1 easily changes. In this embodiment, the first electrode L1 of the capacitive element C0 is maintained at the potential VST during the light-emitting period PEL, and thus the potential VG of the gate of the drive transistor Tdr is maintained at an almost constant level over the entire light-emitting period PEL. Accordingly, it is possible to make the electro-optical element 11 emit light with a predetermined brightness with high precision by preventing the driving current Iel from varying. In other words, even though the capacitance of the capacitive element C0 is not enough, it is possible to maintain the potential VG of the gate of the drive transistor Tdr at an almost constant level. Accordingly, the capacitance of the capacitive element C0 can be decreased in comparison with the structure shown in FIG. 15, in which a large capacitance is needed in order to maintain the potential VG at a constant level. Further, the structure shown in FIG. 15 requires an additional storage capacitor C1 in addition to the capacitive element C0 in order to securely ensure the potential VG. However, with the structure according to this embodiment, as shown in FIG. 2, it is possible to maintain the potential VG of the gate of the drive transistor at a constant level even with a small capacitance and to omit the storage capacitor C1 shown in FIG. 15. As described above, the pixel circuit P is advantageous in that it has a small size because the capacitance needed therefore is decreased.

D: Advantage

Figure 9:
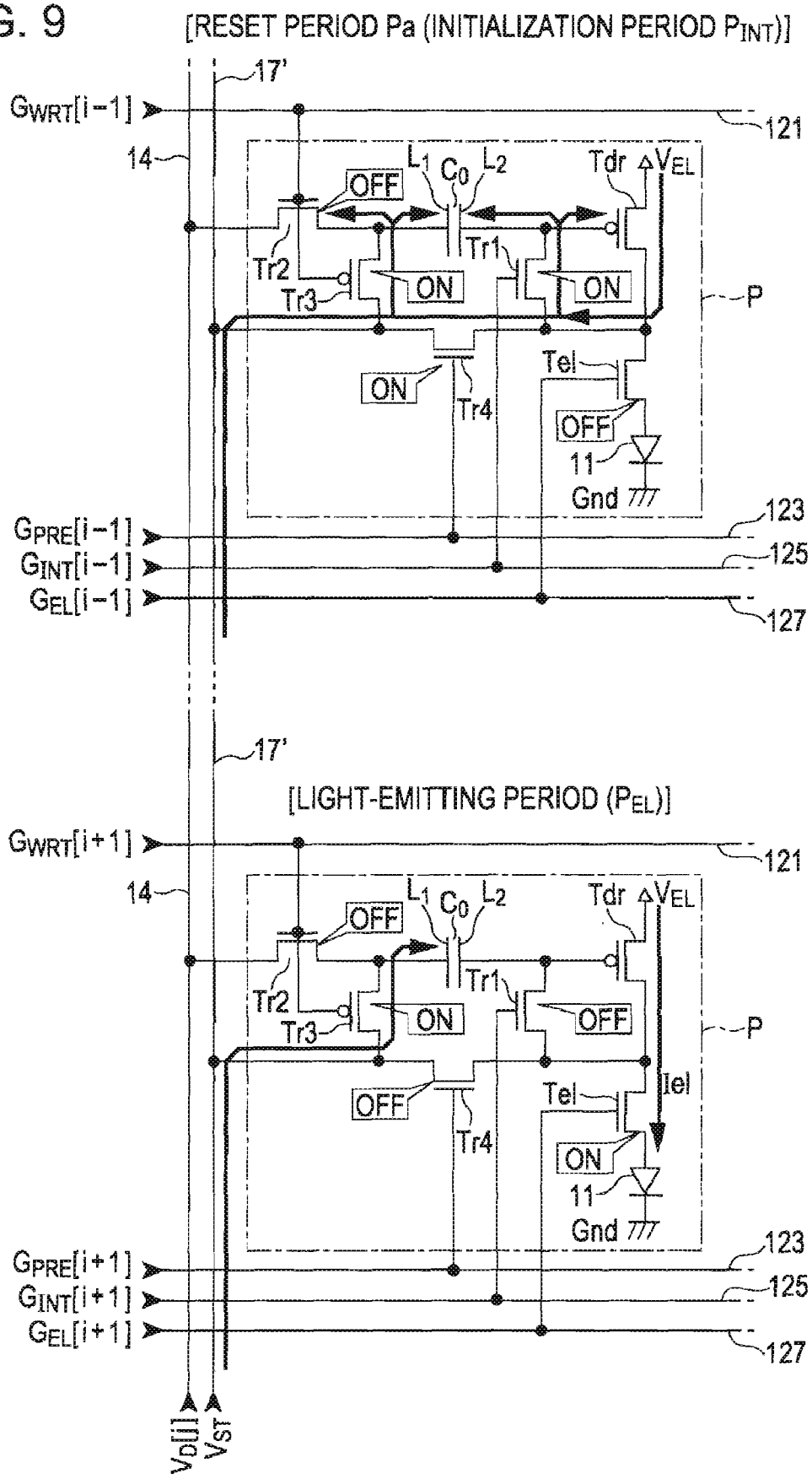
FIG. 9 is a circuit diagram for explaining the operation of a pixel circuit according to a comparison example in a reset period.

As shown in FIG. 4, the operations of the initialization period PINT (from the reset period Pa to the compensation period Pb), the writing period PWRT, and the light-emitting period PEL with respect to a scan line are repeatedly performed by shifting the scan lines one by one. For example, when the electro-optical elements 11 in the (i−1)-th row performs the operations corresponding to the initialization period PINT (reset period Pa), the electro-optical elements 11 in the (i+1)-th row perform the operations corresponding to the light-emitting period PEL. For this reason, as shown in FIG. 9, when the electric supply line 17' is arranged to be perpendicular to the control line 12 including the scan line 121, the first control line 123, the second control line 125, and the light-emitting control line 127, the initialization current of the electro-optical elements 11 in the (i−1)-th row flows into the electrical supply line 17' during the electro-optical elements 11 in the (i+1)-th row emit light. Thus the potential of the electric supply line 17' changes due to this current. As a result, the brightness of the light emitted from the electro-optical elements 11 in the (i+1)-th row varys, and thus the flickering occurs.

With respect to this point, in this embodiment, the electric supply line 17 is arranged in parallel with the control line 12 including the scan line 121, the first control line 123, the second control line 125, and the light-emitting control line 127. Accordingly, the states (periods) of the electro-optical elements 11 which can be connected to one electric supply line 17 are identical to another. Accordingly, in the initialization period PINT (reset period Pa), the reset current from, the electro-optical elements 11 in the same row flows along the shared electric supply line 17, but does not cause any changes in the potentials of the other electric supply lines 17 coupled to electro-optical elements 11 in the other rows. It is therefore possible to prevent occurrence of flickering attributable to the variation in the light-emitting brightness.

Figure 10A:
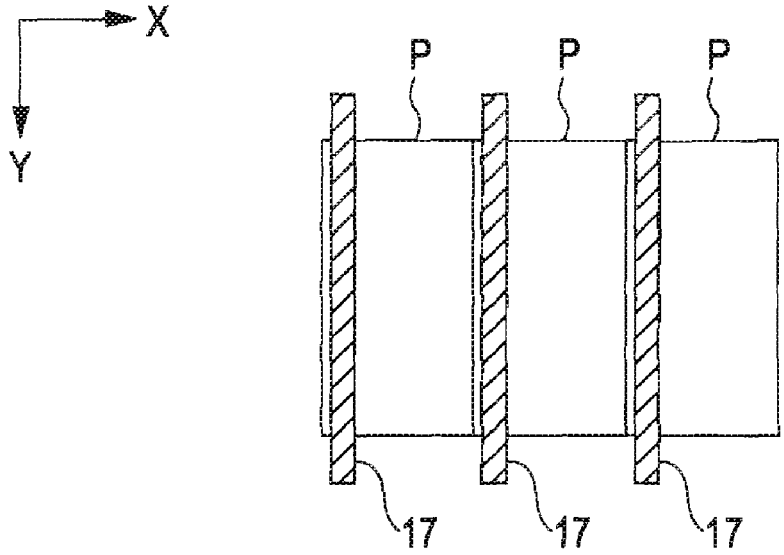
FIG. 10 is a schematic view illustrating the relationship between an electric supply line and the pixel circuit.
Figure 10B:
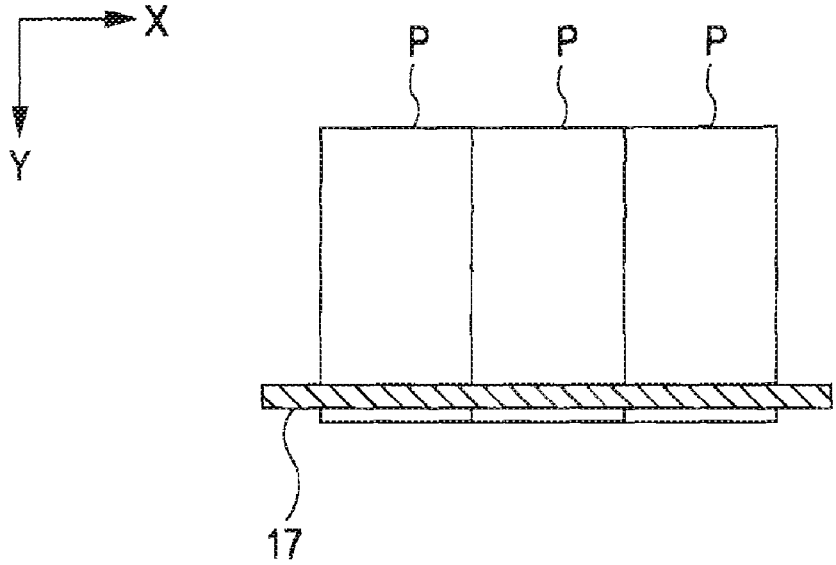

As shown in FIG. 10A, when the electric supply lines 17 are arranged to extend in the Y direction perpendicular to the direction of the control line 12, a large number of electric supply lines 17 is needed. That is, the number of electric supply lines 17 must be equal to the number of columns of the pixel circuits P. For this reason, according to this embodiment, as shown in FIG. 10B, the electric supply line 17 is arranged to extend in the X direction in parallel with the direction of the control line 12. Accordingly, a single electric supply line 17 can be shared by every column of the pixel circuits P. In addition, the pixel circuit P is longer in the Y direction than in the X direction. Accordingly, when the electric supply line 17 is arranged in parallel with the control line 12, an area taken by the electric supply line 17 is relatively small in comparison with an area taken by the electro-optical elements 11. As a result, an aperture ratio is increased.

E: Modification of Embodiment

The electro-optical devices according to the aforementioned embodiments can be diversely modified. Concrete examples of the modification will be described below. Alternatively, the examples below may be properly combined.

(1) First Modification

Figure 11:
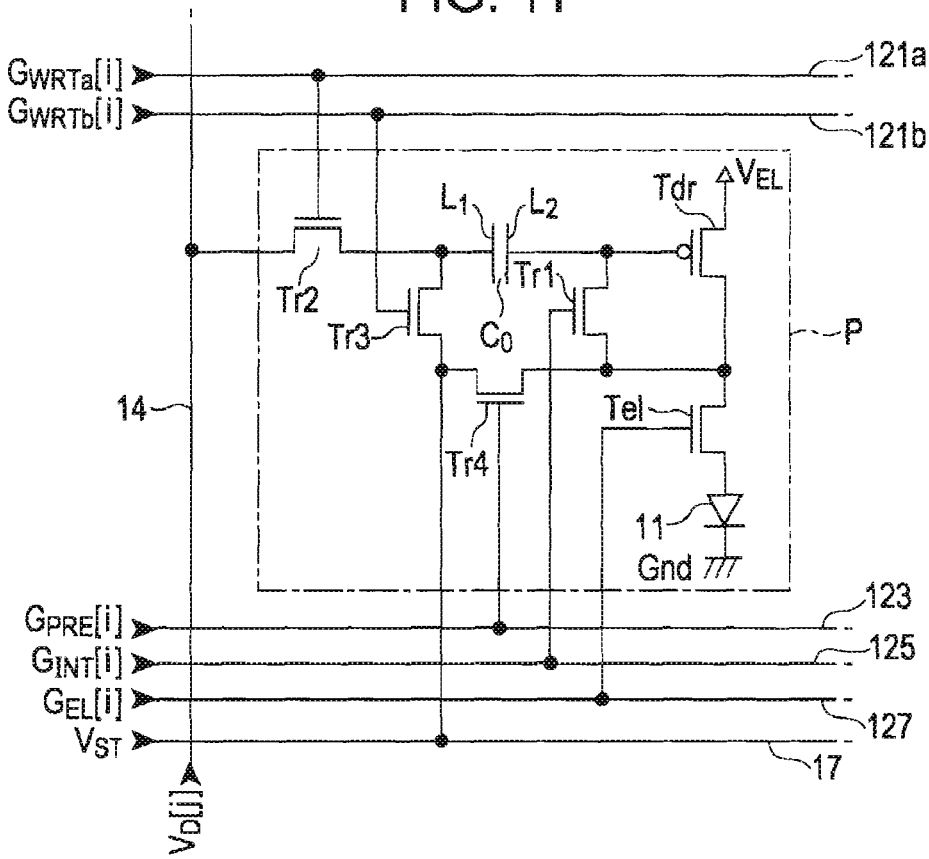
FIG. 11 is a circuit diagram illustrating a pixel circuit according to a modification example of the embodiment of the invention.

In the aforementioned embodiments, the transistors Tr2 and transistor Tr3 are counter conductive transistors to each other. However, the structure in which the transistor Tr2 and the transistor Tr3 operate in a complementary manner is not limited thereto. For example, as shown in FIG. 11, the transistors Tr2 and Tr3 may be provided as the same conductive-type transistors (n-channel transistors in this example). According to this example, a gate of the transistor Tr2 is connected to the first scan line 121*a* and a gate of the transistor Tr3 is connected to the second scan line 121*b*. The first scan line 121*a* is supplied with the first scan signal GWRTa(i) which is the same as the scan signal GWRT(i) shown in FIG. 4, and the second scan line 121*b* is supplied with the second signal GWRTb(i) which is logically reverse to the first scan signal GWRTa(i). The operation of this structure is also the same as that in FIGS. 5 to 8. Most of all, in the structure in which the transistor Tr2 and the transistor Tr3 are counter conductive to each other as shown in FIG. 2, the transistors Tr2 and Tr3 can be controlled by the same scan line 121. Accordingly, such a structure is advantageous in that the structure thereof is simplified.

(2) Second Modification

Figure 12:
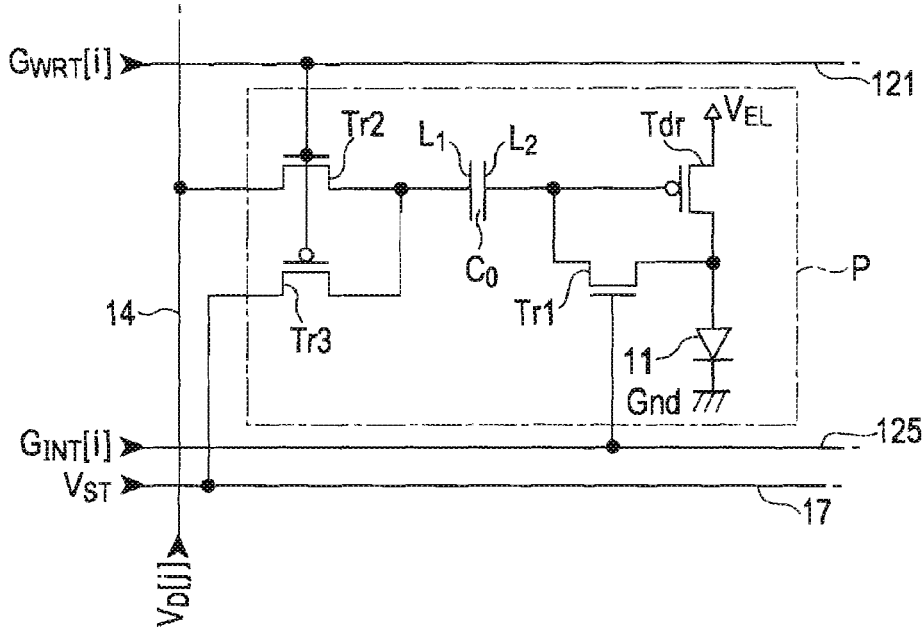
FIG. 12 is a circuit diagram illustrating a pixel circuit according to another modification example of the embodiment of the invention.

In this modification example, the transistor Tr4 and the light emission control transistor Tel shown in FIG. 2 are adequately omitted. FIG. 12 shows a circuit of a pixel circuit P in which the transistor Tr4 and the light emission control transistor Tel shown in FIG. 2 are omitted. In this structure, the scan signal GWRT(i) is the low level and thus the initialization signal GINT(i) is the high level during the initialization period PINT. Accordingly, as the transistor Tr3 is transited to the on-state, the potential of the gate of the drive transistor connected as a diode via the transistor Tr1 is converged to the potential VG(=VEL−Vth) corresponding to the threshold voltage of the gate of the drive transistor while the first electrode L1 is maintained at the potential VST.

During the subsequent period PWRT, the transistor Tr1 is turned off due to the low level of the initialization signal GINT(i). In addition, scan signal GWRT(i) is transited to the high level and thus the transistor Tr2 is turned on. As a result, the gate of the drive transistor Tdr is set to the potential VG (the formula (1)) corresponding to the data potential VD(i) based on the same principle applied to the first embodiment.

During the light emitting period PEL, both of the scan signal GWRT(i) and the initialization signal GINT(i) are maintained at the low level. Thanks to the low level of the scan signal GWRT(i), the transistor Tr3 is turned on and thus the potential of the first electrode L1 is fixed at the potential VST. Accordingly, it is possible to prevent the variation in the potential VG of the gate of the drive transistor Tdr from occurring. As described above, since it is possible to avoid the floating state of the first electrode L1 in the structure shown in FIG. 11, it is possible to suppress the variation in the potential of the gate of the drive transistor while inhibiting the increase in the size of the pixel circuit P likewise the structure of the first embodiment.

(3) Third Modification

The conductivity of the transistors constituting the pixel circuit P may be properly changed. For example, the drive transistor Tdr shown in FIG. 2 may be provided as an n-channel transistor. Even in this case, the potential VST of the electric supply line 17 is set to a level by which the drive transistor Tdr can be turned on when it is supplied to the gate of the drive transistor Tdr. IN addition, when the drive transistor Tdr is a n-channel transistor, the drive transistor Td1 is interposed between the gate of the drive transistor Tdr and the power source line (potential VEL). An OLED element is just an example of the electro-optical element 11. For example, instead of the OLED element, a variety of light-emitting elements such as an inorganic EL element or an LED (Light Emitting Diode) element may be used as the electro-optical element. In this embodiment, the electro-optical element is not limited in its structure. That is, the electro-optical element may have any structures as long as it displays a level of gray scale when a current is supplied thereto.

F: Application

Figure 13:
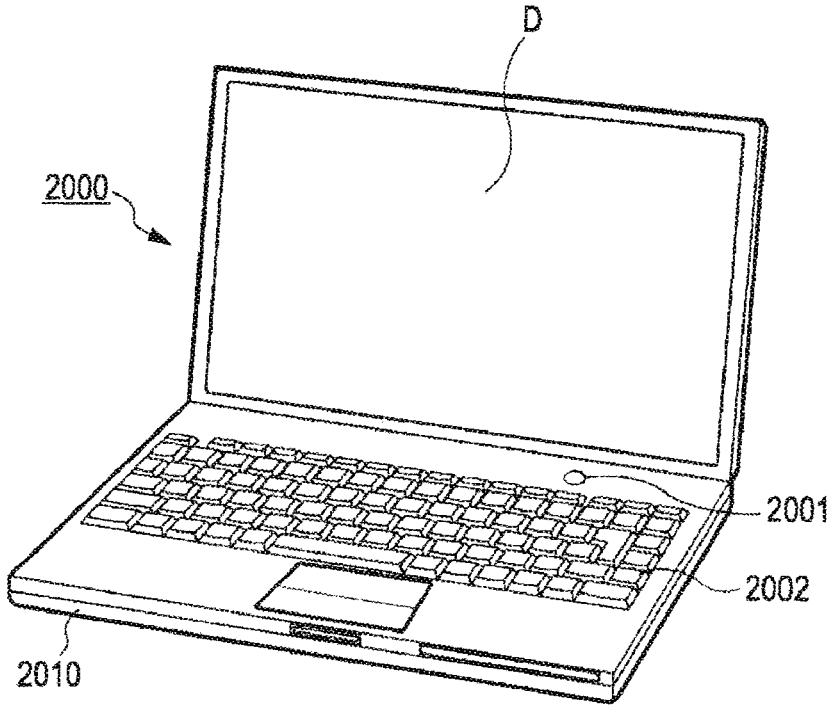
FIG. 13 is a perspective view illustrating an overall structure of an electronic apparatus according to the invention.

Hereinafter, an electronic apparatus using the electro-optical device D according to the invention will be described. FIG. 13 shows the structure of a mobile personal computer including the electro-optical device D according to any of the embodiments and modifications thereof as a display device. The personal computer 2000 includes the electro-optical device D serving as a display device and a body part 2010. The body part 2010 includes a power switch 2001 and a keyboard 2002. The electro-optical device D includes an OLED element as an electro-optical element 11, and thus it is possible to display an image at a large view angle, so that it can be conveniently viewed by a viewer.

Figure 14:
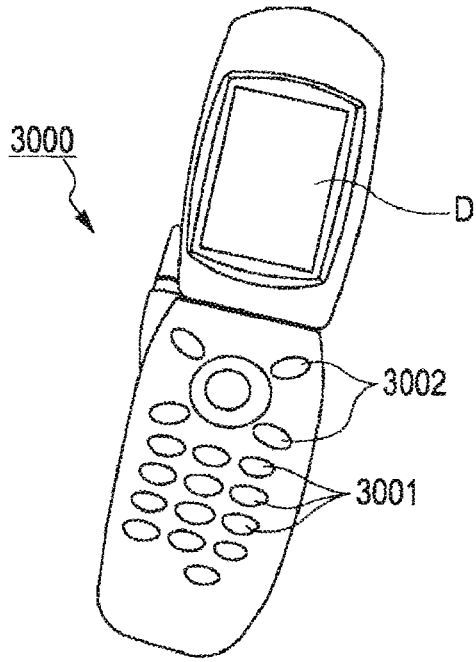
FIG. 14 is a perspective view illustrating a detailed structure of the electronic apparatus according to the invention.

FIG. 14 shows the structure of a mobile phone including the electro-optical device D according to any of the embodiments and modifications of the invention therein. The mobile phone 3000 includes a plurality of manipulation buttons 3001, a scroll button 3002, and the electro-optical device D serving as a display device. When the scroll button 3002 is manipulated, an image displayed on the electro-optical device D is scrolled.

FIG. 15 shows the structure of a Personal Digital Assistants (PDA) including the electro-optical device D according to any of the embodiments and modifications of the invention. The PDA 4000 includes a plurality of manipulation buttons 4001, a power switch 4002, and the electro-optical device D serving as a display device. When the power switch 4002 is manipulated, a variety of information such as a list of addresses and a time table of schedules is displayed on the electro-optical device D.

In addition to the electronic apparatuses shown in FIGS. 13 to 15, There are more electronic apparatuses including electro-optical devices according to any of the embodiments and modifications of the invention. Examples thereof are a digital camera, a television, a vide camera, a car navigation device, a pager, an electronic organizer, an electronic paper, a calculator, a word-processor, a workstation, a video phone, a POS terminal, a printer, a scanner, a copying machine, a vide player, a touch panel, and etc. The use of the electro-optical device according to the invention is not limited to a display device. For example, the electro-optical device according to the invention can be used as the recording head which is a device to expose a photoconductor with a corresponding image to be formed on a recording medium such as paper in an image forming device such as an optical recording printer and an electronic copying machine. The electronic circuit in the invention must be broadly understood to include a circuit serving as a unit of exposing in an image forming device as well as a pixel circuit constituting a pixel of a display device.

What is claimed is:

1. An electro-optical device, comprising:

a plurality of data lines;

a plurality of scan lines; and a plurality of unit circuits disposed to correspond to respective intersections of the plurality of data lines and the plurality of scan lines, wherein each of the plurality of data lines is supplied with a data potential corresponding to a level of gray scale and each of the plurality of scan lines is supplied with a scan signal which defines a writing period in which the data potential is loaded to the corresponding unit circuit, wherein each of the plurality of unit circuits, includes:

a drive transistor for generating a driving current corresponding to a potential of a gate thereof;

an electro-optical element displaying a level of gray scale corresponding to the driving current;

a capacitive element having a first electrode and a second electrode;

an electric supply line which is electrically connected to the second electrode of the capacitive element in an initialization period other than the writing period and which is supplied with a predetermined potential;

a control line having a first control line wiring, a second control line wiring, a light-emitting control line wiring and a scan line wiring corresponding to one of the plurality of scan lines;

the electric supply line extends in a direction so as to not intersect the control line;

a first switching element for electrically connecting the gate and a drain of the drive transistor to each other during at least the initialization period;

a second switching element for controlling electrical connection and disconnection between the data line and the first electrode of the capacitive element on the basis of the scan signal, a third switching element for controlling electrical connection and disconnection between the electric supply line and the first electrode of the capacitive element and for electrically connecting the electric supply line and the first electrode of the capacitive element to each other during at least the initialization period, wherein the second electrode of the capacitive element is connected to the gate of the drive transistor and the electric supply line extends in a direction so as not to intersect the scan line, the third switching element is in an on-state when the second switching element is in an off-state, and the third switching element is operated on the basis of the scan signal.

2. The electro-optical device according to claim 1 wherein the electric supply line is formed of a wiring layer which is the same layer used for forming the gate of the drive transistor.

3. The electro-optical device according to claim 1, wherein the second switching element and the third switching element of each of the plurality of unit circuits are counter conductive transistors to each other and a gate of the second switching element and a gate of the third switching element are supplied with a common scan signal.

4. An electronic apparatus comprising the electro-optical according to claim 1.

5. The electro-optical device according to claim 1, further comprising a power supply line which is electrically connected to a source of the drive transistor.

6. The electro-optical device according to claim 1, wherein the electric supply line supplies the predetermined potential to each of the plurality of unit circuits along a single scan line.

7. An electro-optical device, comprising:

a plurality of data lines;

a plurality of scan lines; and a plurality of unit circuits disposed to correspond to respective intersections of the plurality of data lines and the plurality of scan lines, wherein each of the plurality of data lines is supplied with a data potential corresponding to a level of gray scale and each of the plurality of scan lines is supplied with a scan signal which defines a writing period in which the data potential is loaded to the corresponding unit circuit, wherein each of the plurality of unit circuits, includes:

a drive transistor for generating a driving current corresponding to a potential of a gate thereof;

an electro-optical element displaying a level of gray scale corresponding to the driving current;

a capacitive element having a first electrode and a second electrode;

an electric supply line which is electrically connected to the second electrode and supplied with a predetermined potential during an initialization period other than the writing period, a control line having a first control line wiring, a second control line wiring, a light-emitting control line wiring and a scan line wiring corresponding to one of the plurality of scan lines;

the electric supply line extends in a direction so as to not intersect the control line;

a first switching element for electrically connecting the gate and a drain of the drive transistor to each other during at least the initialization period; and a second switching element for controlling electrical connection and disconnection between the data line and the first electrode on the basis of the scan signal, a third switching element for controlling electrical connection and disconnection between the electric supply line and the first electrode of the capacitive element and for electrically connecting the electric supply line and the first electrode of the capacitive element to each other during at least the initialization period, wherein a gate of the second switching element is connected to the scan signal and the electric supply line is arranged in parallel with the scan line, the third switching element is in an on-state when the second switching element is in an off-state, and the third switching element is operated on the basis of the scan signal.

8. The electro-optical device according to claim 7, further comprising a power supply line which is electrically connected to a source of the drive transistor.

9. An electro-optical device, comprising:

a plurality of data lines;

a plurality of scan lines;

an electric supply line; and a plurality of unit circuits disposed to correspond to respective intersections of the plurality of data lines and the plurality of scan lines, wherein each of plurality of the data lines is supplied with a data potential corresponding to a level of gray scale, each of the plurality of scan lines is supplied with a scan signal which defines a writing period that it takes for the data potential to be loaded into the corresponding unit circuit, and the electric supply line is supplied with a predetermined potential, wherein each of the plurality of unit circuits includes:

a drive transistor for generating a driving current corresponding to a potential of a gate thereof;

an electro-optical element displaying a level of gray scale corresponding to the driving current;

a control line having a first control line wiring, a second control line wiring, a light-emitting control line wiring and a scan line wiring corresponding to one of the plurality of scan lines;

the electric supply line extends in a direction so as to not intersect the control line;

a first switching element for controlling electrical connection and disconnection between the gate and a drain of the drive transistor;

a capacitive element having a first electrode and a second electrode;

a second switching element for controlling electrical connection and disconnection between each of the plurality of data lines and the first electrode on the basis of the scan signal;

a third switching element which is a switching element for controlling electrical connection and disconnection between the electric supply line and the first electrode, which is in an on-state when the second switching element is in an off-state, and which is in the off-state when the second switching element is in the on-state; and a fourth switching element interposed between the first electrode and the second electrode for controlling electrical connection and disconnection between the first electrode and the second electrode, and wherein the second electrode is connected to the gate of the drive transistor and the electric supply line extends in a direction so as not to intersect the scan line, and the third switching element is operated on the basis of the scan signal.

10. The electro-optical device according to claim 9, further comprising a power supply line which is electrically connected to a source of the drive transistor.

11. An electro-optical device, comprising:

a plurality of data lines;

a plurality of scan lines;

an electric supply line; and a plurality of unit circuits disposed to correspond to respective intersections of the plurality of data lines and the plurality of scan lines, wherein each of the plurality of data lines is supplied with a data potential corresponding to a level of gray scale, each of the plurality of scan lines is supplied with a scan signal which defines a writing period in which the data potential is loaded into the corresponding unit circuit, and the electric supply line is supplied with a predetermined potential, wherein each of the plurality of unit circuits includes:

a drive transistor generating a driving current corresponding to a potential of a gate thereof;

an electro-optical element displaying a level of gray scale corresponding to the driving current generated by the drive transistor;

a control line having a first control line wiring, a second control line wiring, a light-emitting control line wiring and a scan line wiring corresponding to one of the plurality of scan lines;

the electric supply line extends in a direction so as to not intersect the control line;

a first switching element for controlling electrical connection and disconnection between the gate and a drain of the drive current;

a capacitive element having a first electrode and a second electrode;

a second switching element for controlling electrical connection and disconnection between each of the plurality of data lines and the first electrode on the basis on the scan signal;

a third switching element which is a switching element for controlling electrical connection and disconnecting between the electric supply line and the first electrode, which is in an off-state when the second switching element is in an on-state, and which is in the on-state when the second switching element is in the off-state; and a fourth switching element interposed between the first electrode and the second electrode for controlling electrical connection and disconnection between the first electrode and the second electrode, and wherein the second electrode is connected to the gate of the drive transistor and the electric supply line is arranged in parallel with the scan line, and the third switching element is operated on the basis of the scan signal.

12. The electro-optical device according to claim 11, further comprising a power supply line which is electrically connected to a source of the drive transistor.

* * * * *